US005979356A

United States Patent [19]

Emery

[11] Patent Number: 5,979,356

[45] Date of Patent: Nov. 9, 1999

[54] SEWING MACHINE NEEDLE INDICATING DEVICE

[76] Inventor: Linda Goodmon Emery, P.O. Box 811, Derby, Kans. 67037

[21] Appl. No.: 08/944,939

[22] Filed: Oct. 2, 1997

[51] Int. Cl.[6] ..... G09F 9/40

[52] U.S. Cl. ..... 116/324

[58] Field of Search ..... 116/321, 322, 116/323, 324

[56] References Cited

U.S. PATENT DOCUMENTS

| | | | |
|---|---|---|---|
| 711,240 | 10/1902 | Zaring | 116/321 |
| 1,848,815 | 3/1932 | Andersson | 116/315 |
| 1,892,163 | 12/1932 | Rose | 116/324 |
| 2,598,792 | 6/1952 | Heine | 116/324 |
| 2,699,140 | 1/1955 | Fisher | 116/324 |
| 4,712,504 | 12/1987 | Zarley et al. | 116/222 |
| 4,825,803 | 5/1989 | Ammann et al. | 116/324 |
| 5,305,706 | 4/1994 | Arjomand | 116/234 |
| 5,489,122 | 2/1996 | Pittner | 116/323 X |

OTHER PUBLICATIONS

Author: Unknown; Title of Article: Needle Tracker; Title of Item: The Creative Machine; Date: Fall, 1997; Publisher: Open Chain Publishing; Place of Publication: Menlo Park, CA (see attachment).

*Primary Examiner*—Hezron Williams
*Assistant Examiner*—Willie Morris Worth
*Attorney, Agent, or Firm*—Kenneth Jack

[57] ABSTRACT

A needle indicator including a display plate, the display plate being mountable on a sewing machine for viewing by a sewing machine operator; needle size indicia fixedly attached to or homogeneously fused with the display plate; needle type indicia fixedly attached to or homogeneously fused with the display plate; a size indicia marker slidably mounted upon the display plate, the size indicia marker being capable of alternately and selectively designating the needle size indicia; and a type indicia marker slidably mounted upon the display plate, the type indicia marker being capable of selectively and alternately designating the needle type indicia.

10 Claims, 6 Drawing Sheets

SEWING MACHINE NEEDLE INDICATING DEVICE

FIELD OF THE INVENTION

This invention relates to apparatus applicable to sewing machines, the apparatus serving as a record or visual reminder of the size and type of sewing machine needle installed in a sewing machine.

BACKGROUND OF THE INVENTION

Several differing sewing machine needle types are utilized in a common sewing machine. For example, when fine knitted materials are to be sewn, a ballpoint needle is utilized, the rounded ballpoint spreading the fibers of the knitted fabric rather than cutting such fibers. Where dense fabric such as denim is to sewn, a denim needle having a sharp wedged shaped point is utilized for efficient penetration of the fabric. Another unique example of a sewing machine needle utilized in a sewing machine is a machine embroidery needle having an enlarged eye for prevention of shredding and breakage of machine embroidery thread. Other sewing machine needles having unique features are known by the common names: Universal, Sharp/Denim, Stretch, Metallic, Top Stitch, and Quilting. Each of these needle types have a unique configuration of point, eye and shaft making the needle suitable for sewing a particular type of fabric. The unique features of a particular type of sewing machine needle installed in a sewing machine are difficult to visually determine from the viewpoint of a sewing machine operator. Often, a sewing machine operator cannot determine the exact type of sewing machine needle installed in the sewing machine by simply looking at the needle.

In addition to its point and eye characteristics, a common sewing machine needle typically has a standardized shaft diameter. Common sewing machine needle shaft diameter sizes are: 60/8, 65/9, 70/10, 75/11, 80/12, 90/14, 100/16, 110/18, and 120/19; the numbers 60–120 designating sewing machine needle shaft diameters of 0.60 millimeters through 1.2 millimeters, and the numbers 8–19 representing "American" gauges corresponding to the metric shaft diameters. Due to small variations in shaft diameters, a sewing machine operator typically cannot accurately visually determine the shaft size of a sewing machine needle installed in a sewing machine.

The size and type of sewing machine needle installed in a sewing machine is information which is important to a sewing machine operator. Difficulties in visually determining the exact size and type of sewing machine needle installed in a sewing machine have led to utilization of various recording systems for indicating the type of sewing machine needle installed. One such system includes a notepad and pencil wherein the sewing machine operator makes a written record of the size and type of sewing machine needle installed. Upon changing needles, the prior designation noted on the pad is crossed off and the new needle is noted. A disadvantage of such notepad and pencil recording system is that both the notepad and the pencil are easily misplaced or lost among the numerous items kept close at hand by a sewing machine operator. Upon misplacing the notepad, records of sewing machine needle sizes and types may be made upon other pieces of paper available to the operator; ultimately leading to confusion and mistaken needle identification.

Another known method of needle recordation includes a pin cushion have a square grid drawn on its upper surface; each box of the grid having a particular needle size and type written therein. Within each box of the pin cushion grid, a corresponding sewing machine needle is inserted. According to the method, the size and type of sewing machine needle installed in the operator's sewing machine is determined by viewing the pin cushion to determine which box of the grid has its needle missing. The pin cushion method of recordation is undesirable because installation of a needle within the sewing machine is only one of numerous reasons a particular grid box on the pin cushion may be empty. In the event a grid box of the pin cushion is empty due to needle breakage or misplacement, errors in needle identification may occur.

The instant inventive sewing machine needle indicating device solves the above noted problems and disadvantages of the pad and pencil recordation method and the pin cushion recordation method by providing a plastic plate attachable to a sewing machine, the plastic plate having written indicia of sewing machine needle sizes and types and having slidable markers for recording the particular needle size and type installed in the sewing machine. Such inventive device eliminates the need for keeping track of a pad of paper and pencil and it eliminates inaccuracies resulting from missing or broken sewing needles.

PRIOR ART PATENTS

U.S. Pat. No. 5,564,361 issued Oct. 15, 1996, to Satterwhite discloses a clothing usage indicator having indicia of days and months and having slidable markers.

U.S. Pat. No. 2,888,899 issued Jun. 2, 1959, to Graham discloses an index marker having numerical indicia and slidable markers.

U.S. Pat. No. 5,305,706 issued Apr. 26, 1994, to Arjomand discloses a page number indicating bookmarker having page indicia and slidable markers.

U.S. Pat. No. 3,763,820 issued Oct. 9, 1973, to Sage discloses a key tag having numeric mileage indicia and slidable markers.

U.S. Pat. No. 1,369,213 issued Feb. 22, 1921, to Bachelder discloses a needle and shuttle dispensing cabinet.

U.S. Pat. No. 4,208,984 issued Jun. 24, 1980, to Glanzman discloses a razor having day usage indicia and a slidable marker.

U.S. Pat. No. 5,081,948 issued Jan. 21, 1992, to Walsh discloses a bookmark having a slidable marker for indicating a particular line of text within a book.

U.S. Pat. No. 5,011,032 issued Apr. 30, 1991, to Rollman discloses a pill bottle having dosage indicia and a slidable marker.

U.S. Pat. No. 5,062,209 issued Nov. 5, 1989, to Rais discloses a disposable razor having day/usage indicia and bendable markers.

U.S. Pat. No. 2,586,930 issued Feb. 26, 1952, to Florence discloses filing cabinets having time indicia and slidable markers.

None of the above noted patents discloses, teaches, or describes the novel, inventive, and unique aspects, benefits and features of the present inventive sewing machine needle indicating device.

BRIEF SUMMARY OF THE INVENTION

A preferred embodiment of the present inventive sewing machine needle size and type indicating device comprises a substantially rectangular sheet of plastic having a front side, a back side, an upper end, a lower end, a left side, and a right side, the vertical dimension of the sheet of plastic preferably is approximately 1.333 inches and the horizontal dimension of the sheet of plastic is preferably approximately 2.187 inches. The sheet of plastic is preferably molded to form four 90 degree bends, the first bend being approximately 0.25 inches from the left edge, the second bend being approximately 0.437 inches from the left edge, the third bend being approximately 1.75 inches from the left edge, and the fourth bend being approximately 2.0 inches from the left edge; the first bend extending the sheet material rearward, the second bend extending the sheet material rightward, the third bend extending the sheet material forward, and the fourth bend extending the sheet material further rightward. The above combination of molded bends within the rectangular plastic sheet forms a needle size and type indicia display surface approximately 1.687 inches by 1.313 inches, such surface being bounded on the left and on the right by raised pointer attachment surfaces.

Slidably mounted on the left pointer attachment surface is a rightward pointing needle size indicia pointer, and slidably mounted on the left pointer attachment surface is a leftward pointing needle type indicia pointer. The forwardly facing surface of each pointer attachment surface is horizontally fretted so that the size and type indicia pointers may slide upward or downward in measured increments, the pointers being retained by the frets in a desired selected position.

Preferably, a printed label is adhesively attached to the indicia display surface. Upon the left side of the adhesive label are printed in a columnar format a list of common needle sizes, and printed on the right side of the adhesive label in columnar form are a list of common sewing machine needle types. Positioning of the adhesive label on the indicia display surface, and positioning of the printed needle sizes and needle types on the adhesive label are adjusted so that the indicia of needle size fall between the frets of the left pointer attachment surface, and so that the indicia of needle type fall between the frets of the right pointer attachment surface. Alternately, the needle size and type indicia may be printed directly onto the indicia display surface. Also, alternately, the needle size and type indicia may take the form of raised lettering and numerals extending forwardly from the indicia display surface.

Preferably, an adhesive pad is attached to the rear side of the sewing machine needle size and type indicating device, such pad being utilized for attachment of the device onto a surface of a sewing machine which is easily viewable by a sewing machine operator.

In operation, a sewing machine operator selects a desired sewing machine needle from a package or container which designates the needle's size and type. Immediately before or after the sewing machine needle is installed into the needle shaft of the sewing machine, the sewing machine operator slidably moves the left pointer of the device upward or downward along the left pointer attachment surface so that the pointer aligns with the needle size indicia matching the needle installed, the frets holding the pointer in the desired position. The operator then slidably moves the right pointer upward or downward along the right pointer attachment surface so that it aligns with the needle type indicia matching the type of needle installed in the machine, the frets of the right pointer attachment surface holding that pointer in place. While the selected sewing machine needle is installed in the sewing machine, the left and right pointers remain unmoved, providing an easily viewable reminder of the size and type of sewing machine needle installed in the machine. Upon changing of sewing machine needles, the above procedure is repeated to record the size and type of the new sewing machine needle selected.

Accordingly, it is an object of the present invention to provide a sewing machine needle size and type indicating device having a sewing machine needle size and type indicia display surface, such surface having written indicia of sewing machine needle sizes and types thereon, the device providing slidable pointers for selected designation and recordation of the size and type of a particular sewing machine needle installed in a sewing machine.

It is a further object of the present invention to provide such a device further providing fretted slide stops for holding slidable pointers in their selected positions.

It is a further object of the present invention to provide such a device further providing alternate adhesively labeled, printed or raised relief needle size and type indicia.

It is a further object of the present invention to provide such a device further providing economy and durability in its construction.

Other and further objects, benefits, and advantages of the present inventive sewing machine needle size and type indicating device will become apparent and known to those skilled in the arts upon review of the Detailed Description which follows, and upon review of the appended drawings.

DETAILED DESCRIPTION OF THE PREFERRED EMBODIMENT

Figure 1:
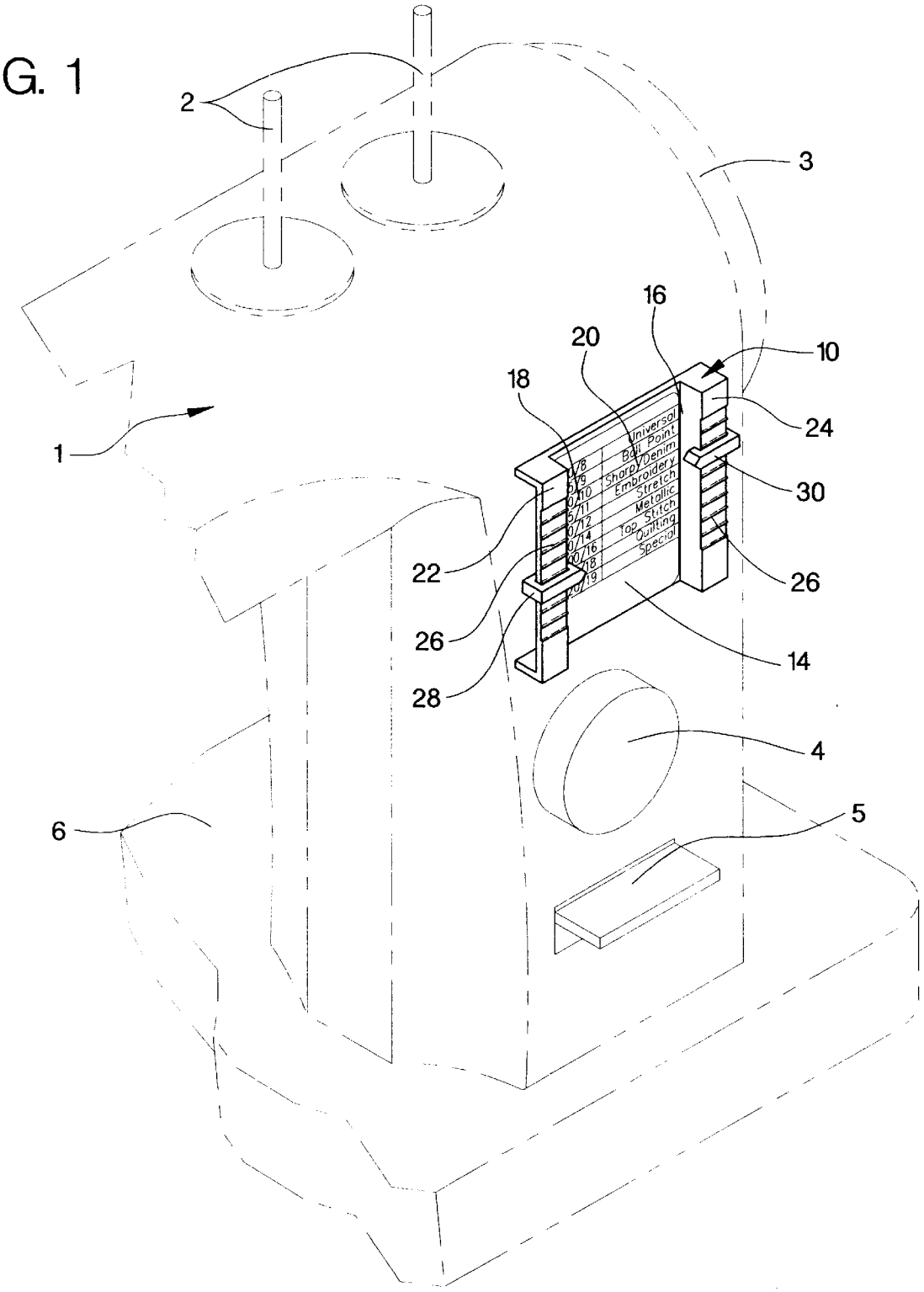
FIG. 1 is an isometric view of the sewing machine needle size and type indicating device, the view indicating its mode of attachment to a common sewing machine.
Figure 6:
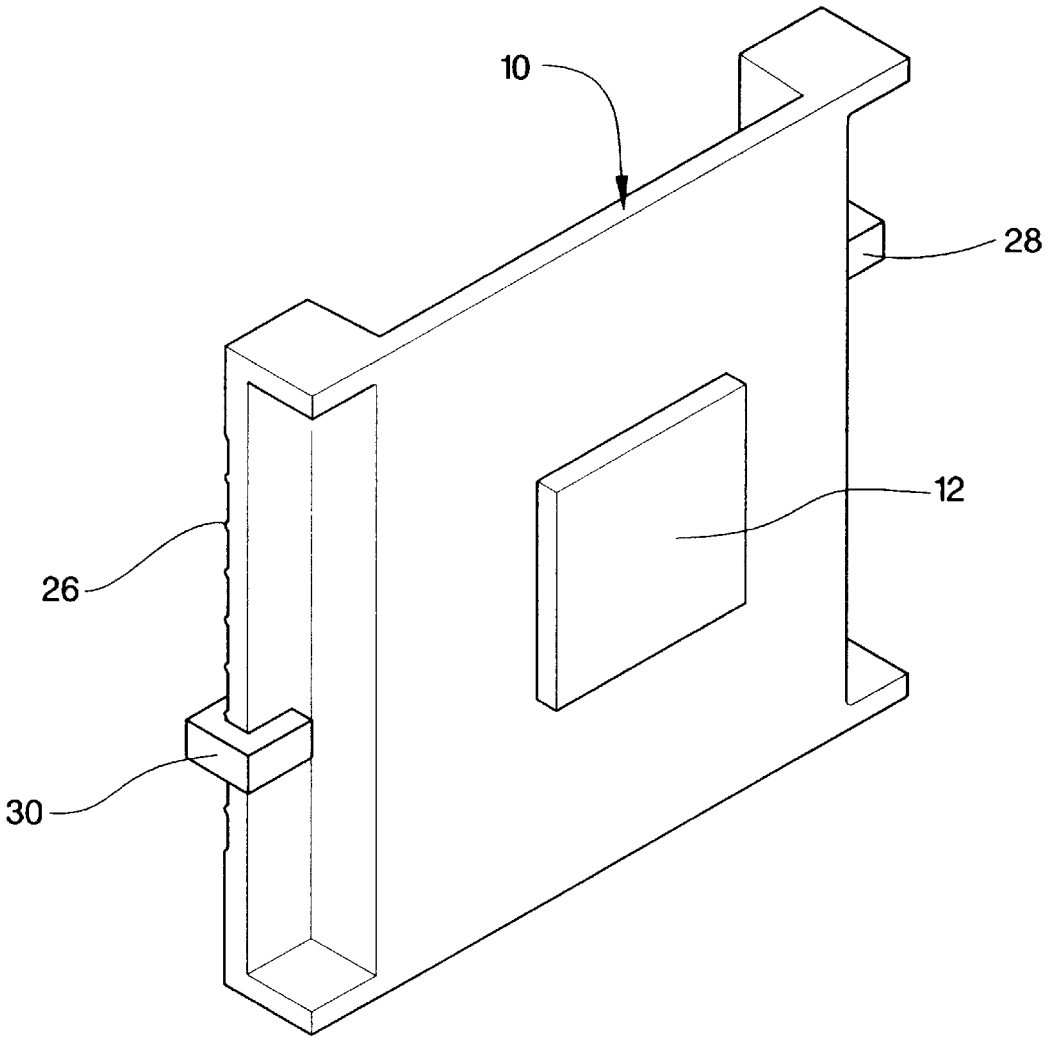
FIG. 6 is an isometric view of the reverse side of the sewing machine needle size and type indicating device.

Referring now to the drawings, and in particular to FIG. 1, a common sewing machine 1 having spool pins 2, a hand wheel 3, a stitch adjustment dial 4, a drop feed lever 5, and having a base plate 6 is depicted; the sewing machine 1 having attached thereto the instant inventive sewing machine needle size and type indicating device 10. Referring to FIG. 6, an adhesive pad 12 is preferably utilized for attaching the device 10 to, referring to FIG. 1, the sewing machine 1.

Figure 2:
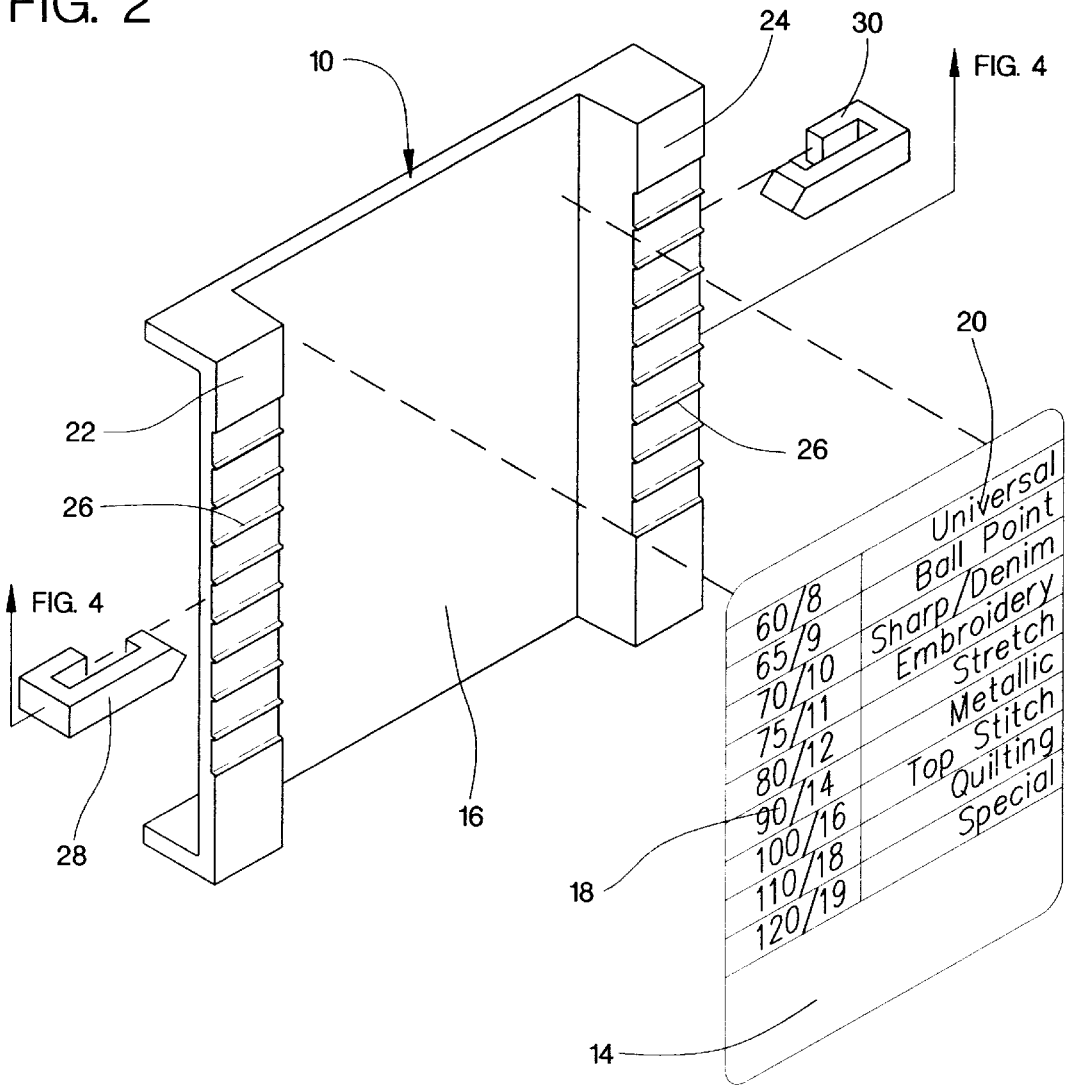
FIG. 2 is an exploded isometric view of the sewing machine needle size and type indicating device.

Referring to FIG. 2, the device 10 is preferably economically composed of injection molded plastic. In the embodiment of FIG. 2, an adhesive label 14 is adhesively attached to the indicia display surface 16 of the device 10. Sewing machine needle size indicia 18 are printed in a columnar format along the left edge of the adhesive label 14, and sewing machine needle type indicia 20 are printed in a columnar format along the right edge of the adhesive label 14.

Referring further to FIG. 2, the device 10 has a raised left pointer attachment surface 22 and a raised right pointer attachment surface 24, each pointer attachment surface 22 and 24 having a series of frets 26 extending outwardly from the pointer attachment surfaces 22 and 24.

Figure 4:
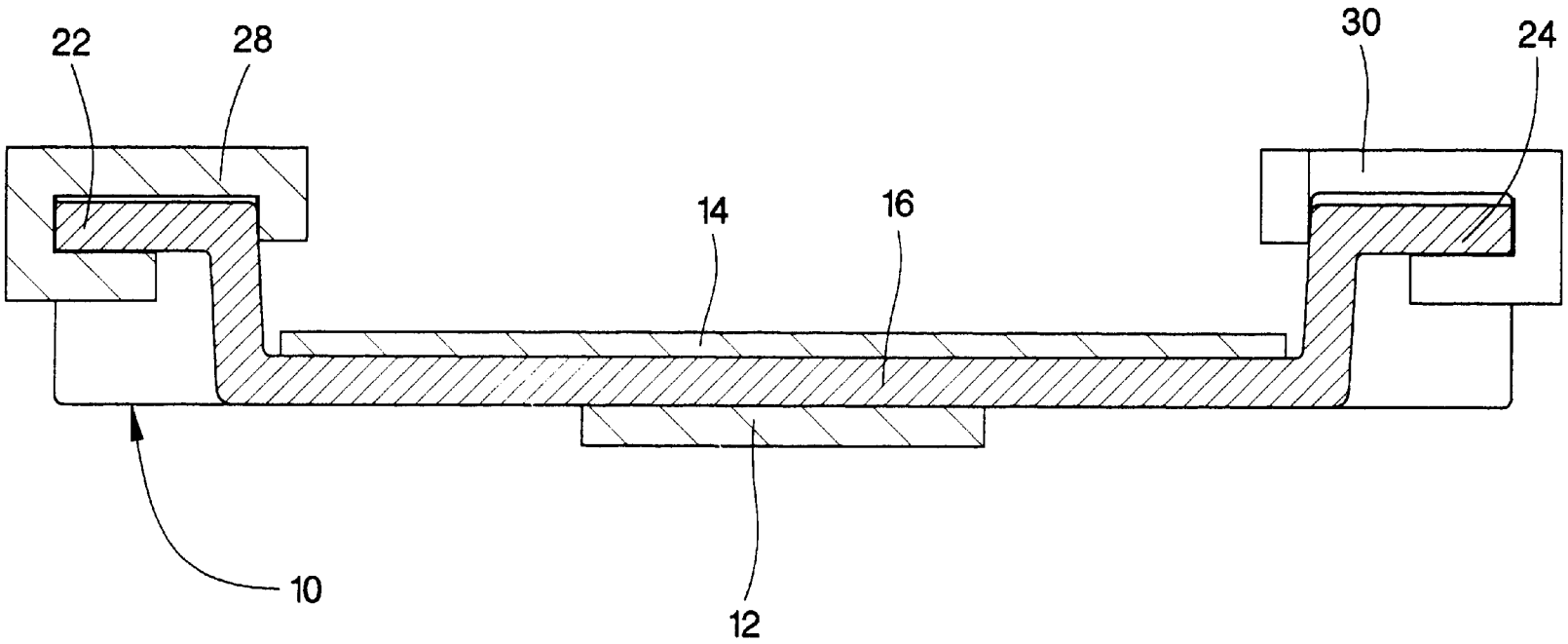
FIG. 4 is a sectional view of the sewing machine needle size and type indicating device, the plane of the section being perpendicular to the vertical midline of the device.
Figure 5:
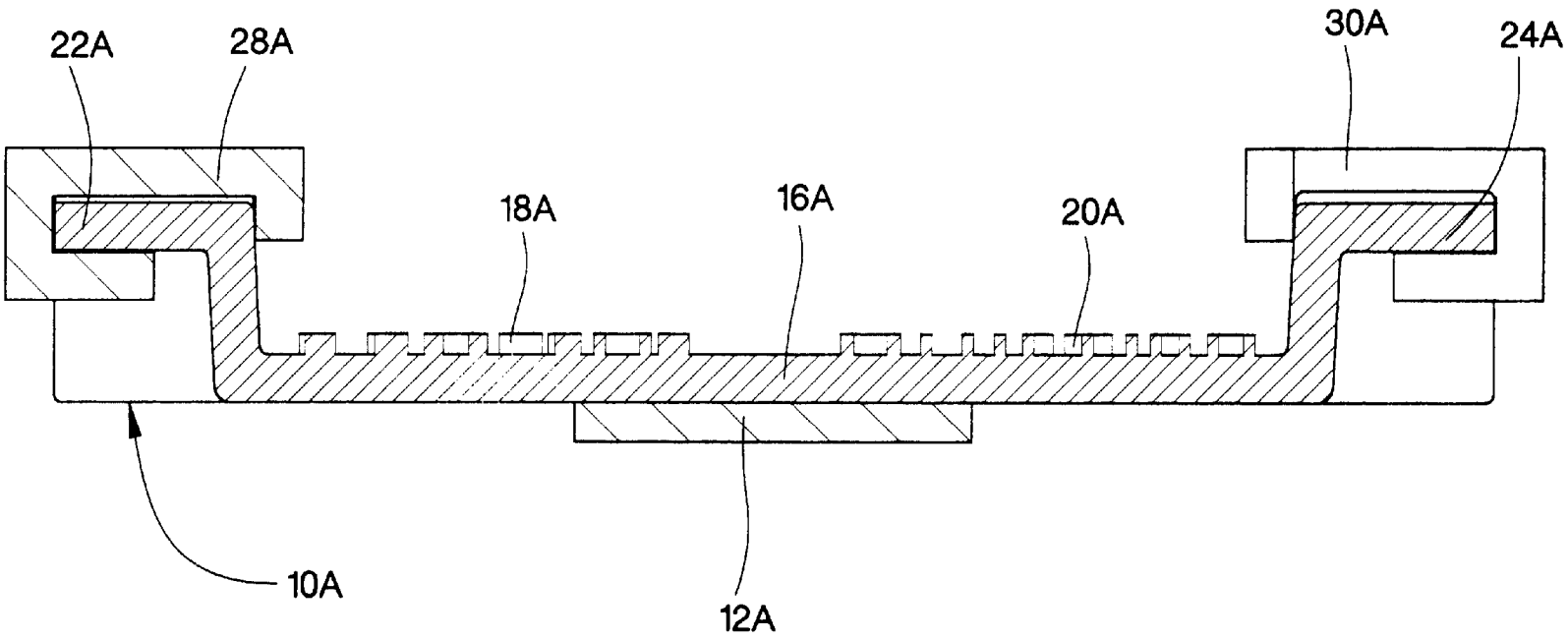
FIG. 5 is an alternate sectional view of the sewing machine needle size and type indicating device, the plane of the section being perpendicular to the vertical midline of the device.

Referring further to FIG. 2, a size indicating pointer 28 and a type indicating pointer 30 are respectively mounted upon the pointer attachment surfaces 22 and 24 so that the upper and lower surfaces of the pointers 28 and 30 each lie between a pair of the frets 26. Referring to FIG. 4, the size indicating pointer 28 and the type indicating pointer 30 are fitted for grasping and being retained upon the pointer attachment surfaces 22 and 24.

Referring to FIG. 1, the sewing machine needle size and type indicating device 10, as depicted, has its size indicating pointer 28 and its type indicating pointer 30 positioned to indicate that a Sharp/Denim needle having a 0.90 millimeter diameter shaft is installed in the sewing machine 1. So long as the 0.90 millimeter Sharp/Denim needle is installed in the sewing machine 1, the size indicating pointer 28 and the type indicating pointer 30 are left in place, the pointers 28 and 30 being held in those positions by the frets 26. In the event a different size or type of sewing machine needle is installed in the machine 1, the sewing machine operator simply slides the needle size pointer 28 upward or downward to designate the size of the replacement needle, and the operator slides the needle type pointer 30 upward or downward to designate the type of the replacement needle.

Figure 3:
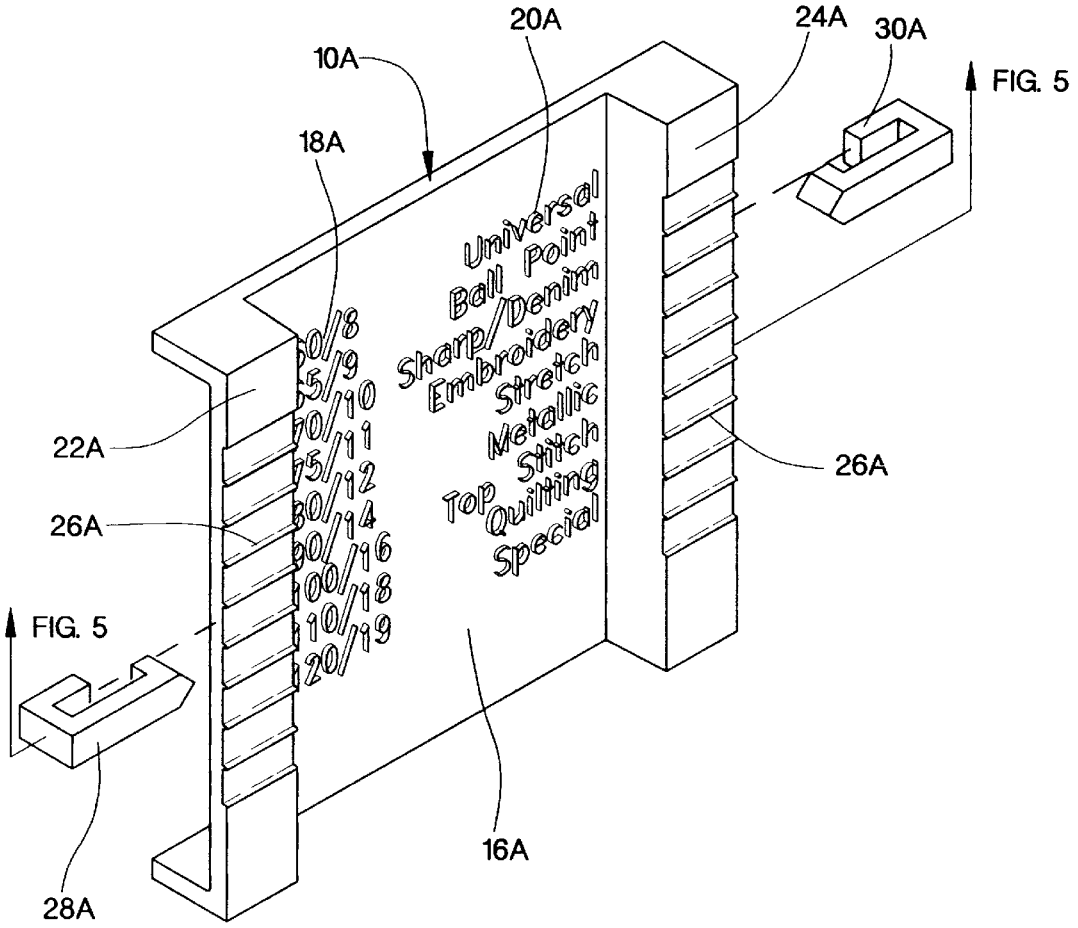
FIG. 3 is an exploded isometric view of an alternate configuration of the sewing machine needle size and type indicating device.

FIG. 3 depicts an alternate configuration 10A of the sewing machine needle size and type indicating device. In the alternate configuration, the pointer attachment surfaces 22A and 24A, the size indicating pointer 28A, the type indicating pointer 30A, and the frets 26A are identical to their corresponding elements 22, 24, 28, 30, and 26 depicted in Drawing FIG. 2. Instead of utilizing the printed label 14 of FIG. 2, raised size indicating numerals 18A and raised type indicating numerals 20A extend outwardly from the indicia display surface 16A. Operation of the alternate sewing machine needle size and type indicating device 10A is identical to operation of the device 10 depicted in FIG. 2.

Referring to FIG. 1, the sewing needle indicating device provides an economic means of recording the type and size of sewing machine needle installed in the sewing machine 1. Only a small amount of injection molded plastic is necessary in the fabrication of the device. The device also provides a highly accurate and consistent means of sewing machine needle identification.

Although the invention herein has been described with reference to particular embodiments, it is to be understood that such embodiments are merely illustrative of the principles and applications of the present invention. It is therefore to be understood that numerous modifications may be made to the illustrative embodiments, and that other arrangements may be devised without departing from the spirit and scope of the present invention as set forth in the appended claims.

I claim:

1. A needle indicator comprising, (a) a display plate, the display plate having a front side and a back side, the back side comprising a sewing machine attachment side;

(b) a plurality of needle size indicia fixedly attached to the front side of the display plate;

(c) a plurality of needle type indicia fixedly attached to the front side of the display plate;

(d) a size indicia pointer slidably mounted upon the display plate so that said pointer may slidably move from a first position wherein said pointer points to one of the needle size indicia, to a second position wherein said pointer points to another of the needle size indicia; and, (e) a type indicia pointer slidably mounted upon the display plate so that pointer may slidably move from a first position wherein said pointer points to one of the needle indicia, to a second position wherein said pointer points to another of the needle type indicia.

2. The needle indicator of claim 1, wherein the needle size and type indicia comprise a printed label adhesively attached to the front side of the display plate.

3. The needle indicator of claim 1, wherein the needle size and type indicia comprise letters and numerals printed on to the front side of the display plate.

4. The needle indicator of claim 1, wherein the needle size and type indicia comprise raised letters and numerals extending outwardly from the front side of the display plate.

5. The needle indicator of claim 2, further comprising a plurality of slide stops fixedly attached to the display plate, the slide stops being fitted and positioned upon the display plate for, upon positioning of the size and type indicia pointers in any position among their first and second positions, resisting sliding motion of such pointers away from such position.

6. The needle indicator of claim 3, further comprising a plurality of slide stops fixedly attached to the display plate, the slide stops being fitted and positioned upon the display plate for, upon positioning of the size and type indicia pointers in any position among their first and second positions, resisting sliding motion of such pointers away from such position.

7. The needle indicator of claim 4, further comprising a plurality of slide stops fixedly attached to the display plate, the slide stops being fitted and positioned upon the display plate for, upon positioning of the size and type indicia pointers in any position among their first and second positions, resisting sliding motion of such pointers away from such position.

8. The needle indicator of claim 5, further comprising an adhesive pad fixedly attached to the sewing machine attachment side of the display plate.

9. The needle indicator of claim 6, further comprising an adhesive pad fixedly attached to the sewing machine attachment side of the display plate.

10. The needle indicator of claim 7, further comprising an adhesive pad fixedly attached to the sewing machine attachment side of the display plate.

* * * * *